United States Patent [19]

Gin

[11] Patent Number: 4,469,326

[45] Date of Patent: Sep. 4, 1984

[54] DEVICE FOR YOGA EXERCISING

[76] Inventor: Abram Gin, 99-40 63 Rd., Forest Hills, N.Y. 11375

[21] Appl. No.: 330,849

[22] Filed: Dec. 15, 1981

Related U.S. Application Data

[62] Division of Ser. No. 851,624, Nov. 15, 1977, Pat. No. 4,307,880.

[51] Int. Cl.[3] ..... A63B 21/00

[52] U.S. Cl. ..... 272/134

[58] Field of Search ..... 272/135, 138, 142, 143, 272/144, DIG. 4, 93, 72, 116

[56] References Cited

U.S. PATENT DOCUMENTS

| | | | |
|---|---|---|---|
| 2,723,856 | 11/1955 | Thomson | 272/135 X |
| 3,567,219 | 3/1971 | Foster | 272/135 |
| 4,307,888 | 12/1981 | Abram | 272/143 |

FOREIGN PATENT DOCUMENTS

| | | | |
|---|---|---|---|
| 1281383 | 12/1961 | France | 272/56 |

*Primary Examiner*—Richard J. Apley
*Assistant Examiner*—William R. Browne
*Attorney, Agent, or Firm*—Ilya Zborovsky

[57] ABSTRACT

A device for exercising Yoga has an elongated resiliently deformable element movable to a position in which it is concave but tends to become straight so that the practitioner holding the element is urged to bend forward.

8 Claims, 5 Drawing Figures

DEVICE FOR YOGA EXERCISING

CROSS REFERENCE TO A RELATED APPLICATION

This application is a division of application Ser. No. 851,624, filed Nov. 15, 1977, now U.S. Pat. No. 4,307,880.

BACKGROUND OF THE INVENTION

The present invention relates to a device for exercising Yoga.

It is well known that a Yoga practitioner must assume respective postures for performing respective Yoga exercises. However, up to now Yoga practitioners have assumed respective postures by themselves without the aid of specific devices. This possesses essential disadvantages which will be described hereinbelow. The Yoga exercises assure medical and restoring action only in the case when they are correctly performed. Since the Yoga exercises are substantially complicated to be performed, a person who is going to start exercising encounters many difficulties. Such person may have no time for lengthy studying, he or she may not be sufficiently persistent, he or she may have no trainer for providing competent help, he or she must spend essential time in order to arrive at correct postures, he or she may have some interruptions in studying which make the process even more complicated and return the practitioner back to initial condition, he or she may be unwell after incorrectly mastered posture, and he or she may have excessive weight or be sick. In all these cases it is very difficult to exercise Yoga.

SUMMARY OF THE INVENTION

Accordingly, it is an object of the present invention to provide a device for Yoga exercising which make Yoga exercises more accessible for practitioners.

More particularly, it is an object of the present invention to provide a device for Yoga exercising so that Yoga exercises may be correctly executed substantially independently from practitioner's age, weight, inclination and ability for exercising, persistance, interruptions in mastering the exercises, and without a trainer.

Another object of the present invention is to provide a device for Yoga exercising which has a simple construction and is easy and inexpensive to manufacture.

In keeping with these objects, and others which will become apparent hereinafter, one feature of the present invention resides in a device for Yoga exercising which has a resiliently deformable element movable to a position in which it is concave but tends to become straight so that the practitioner holding said element is urged to bend forward.

When the practitioner executes Yoga exercises with the aid of the above device he or she does not need to be preliminarily trained and can immediately execute the Yoga exercises. This possibility does not depend on practitioner's weight, age, inclination and ability for exercising, persistance, interruptions in exercising and the like. The practitioner does not need to be taught by a trainer. During short time he or she will be convinced in the fact that the device is simple and helpful, and he or she is able to improve his or her health by Yoga exercising.

A further feature of the present invention is that the resiliently deformable element may have two or more separate members connectable with one another so as to form together the resiliently deformable element. When the members are disconnected from one another the device will be more compact and convenient for transportation.

An additional feature of the present invention is that the resiliently deformable element may have a rectilinear contour in an initial position. It is also possible that the resiliently deformable element has a curved contour in the initial position, which contour has a radius of curvature exceeding the radius of curvature of the same in the first, second and third positions. In the third position, the resiliently deformable element has a tendency to assume its initial curvature and thereby urges the practitioner's body to bend forward.

A still further feature of the present invention is that a stop member may be detachably connected to the resiliently deformable element in the concave position. The stop member may have a portion angularly movable relative to the resiliently deformable element so that when the latter is being bent for assuming the convex contour, the portion of the stop member angularly move relative to the resiliently deformable element and assumes a position in which the practitioner's feet are conveniently supported by the thus-moved portion.

Other objects, features and advantages of the present invention will become apparent from the subsequent description, taken in conjunction with the accompanying drawings.

DESCRIPTION OF PREFERRED EMBODIMENTS

Yoga exercising device in accordance with the present invention has a resiliently deformable element 1 which may be constituted of any material having the above characteristic.

Figure 1:
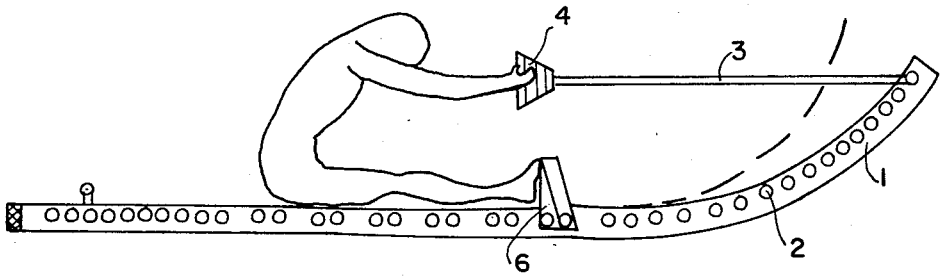
FIG. 1 is a view showing a Yoga exercising device in a concave position of its one portion.
Figure 5:
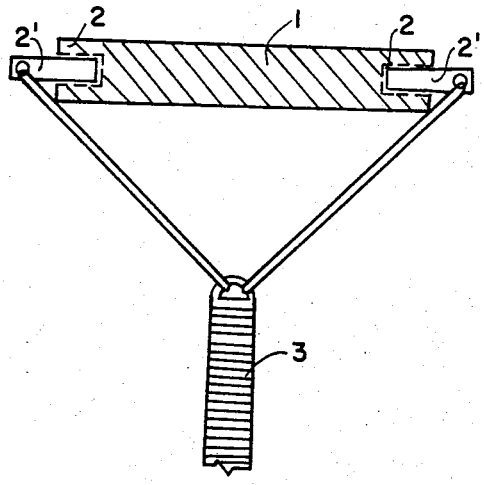
FIG. 5 is a view showing the connecting member connectable with the resiliently deformable element.

As shown in FIG. 1, the deformable element 1 can be bent so that its one portion assumes a concave contour whereas its other portion remains straight. A connecting or holding element 3 may be connected to the deformable element 1 or more particularly to the first-mentioned portion which assumes the concave contour. The deformable element 1 has a plurality of bores 2. The holding element 3 may be connected to the deformable element 1 at any of a plurality of locations by means of pins 2' insertable in the respective bores 2 (as shown in FIG. 5).

When the practitioner rests on the straight portion of the deformable element 1 and grasps a handle element 4 connected to the element 3 by his or her hands, his or her body is urged to bend under the action of the first-mentioned portion of the deformable element 1 which tends to become straight, as shown in FIG. 1, the practitioner places his or her body on the straight portion of the deformable element 1.

Figure 2:
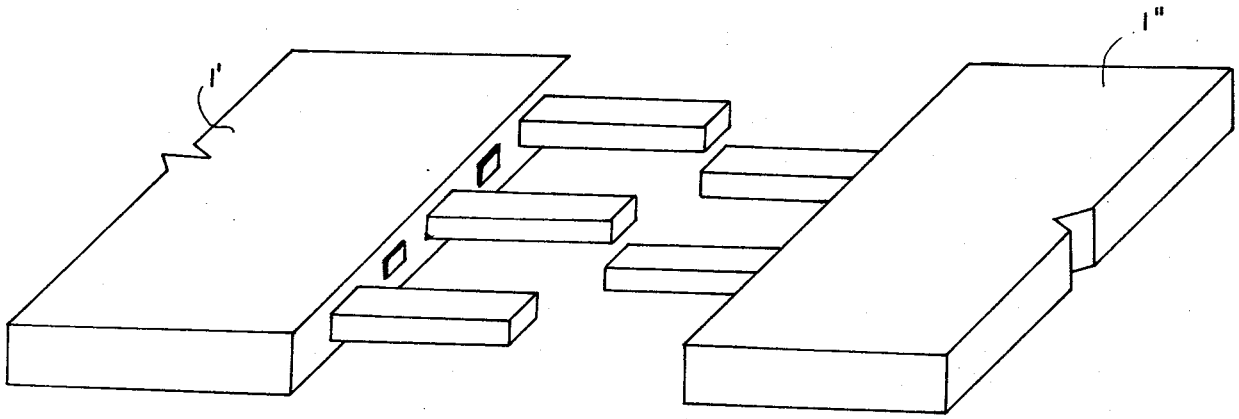
FIG. 2 is a view showing a resiliently deformable element of the Yoga exercising device including two sections detachably connectable with one another.
Figure 3:
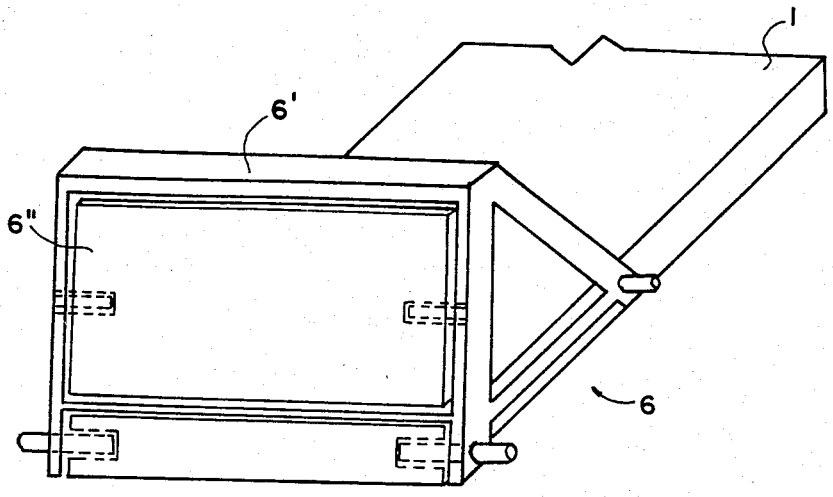
FIG. 3 is a view showing a stop member of the Yoga exercising device.
Figure 4:
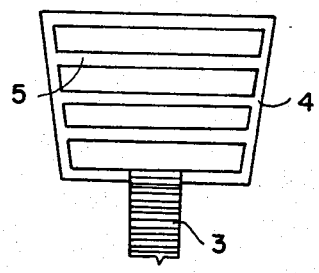
FIG. 4 is a view showing a handle element of the Yoga exercising device, connected with a connecting member.

The deformable element 1 may have two separate section 1' and 1'' detachably connectable with one another, as shown in FIG. 2. Thus-formed element can be easily dismounted so that the device becomes compact and occupies a comparatively small space, for instance, for transportation. As shown in FIG. 4, the handle element 4 has several grasping members 5 spaced from one another in the direction of elongation of the connecting member 3. By grasping a respective member 5 and by insertion of the connecting member 3 into respective bore 2 of the deformable element 1 (by pins 2' as shown in FIG. 5), the practitioner may vary stress applied thereto. The connecting member may also be adjustable in length.

A stop member indentified in toto by reference numeral 6 can be detachably mounted in the respective bores 2 of the deformable element 1 so that the practitioner's feet can abut thereagainst. The stop member 6 has a body portion 6', and a portion 6'' angularly movable relative to the body portion 6'. When the deformable element 1 is bent so that its portion assumes the concave contour and the body portion 6' of the stop member 6 changes its position, the movable portion 6'' can turn so that the practitioner's soles will conveniently rest on the portion 6''. By varying of location of the stop member the practitioner may vary stress applied thereto. The stop member 6 is provided with pin-shaped projections insertable in the bores 2 of the resiliently deformable element 1.

The deformable element 1 in an initial or inoperative position may have a substantially rectilinear contour which subsequently will be changed by bending the portion of the deformable element 1 into a concave position. It is to be understood that the practitioner can bend the deformable element 1 by himself or herself. On the other hand, the deformable element 1 may have in the initial condition a concave contour. In the latter case the deformable element 1 is bent by the practitioner into a more curved contour as compared with that in the initial position. A radius of curvature of the concave portion of the deformable element 1 during exercising will be smaller than that in the initial position, and therefore the practitioner will be urged by the element 1 to bend forward.

The deformable element 1 may be adjustable in the direction of elongation thereof so as to vary its length.

While it will be apparent that the preferred embodiments of the invention herein disclosed are well calculated to fulfill the objects above stated, it will be appreciated that the invention is susceptible to modifications, variations and changes without departing from the proper scope or fair meaning of the subjoined claims. The device may also be used for executing other Yoga exercies which differ from those described above.

What is intended to be protected by a Letters Patent is:

I claim:

1. A Yoga exercising device, comprising an elongated resiliently deformable element means having one portion movable to a position in which said one portion is convex but tends to become straight under the action of its resiliency, and another portion on which a practioner can rest; and holding means by which a practitioner holds said one portion of said resiliently deformable element means in its convex position so as to prevent said one portion from becoming straight whereby said one convex portion acts upon the practitioner's body so as to bend the latter, said holding means including an elongated holding element means having a first end section arranged to be held by a practitioner, and a second end section arranged to be detachably connected with said resiliently deformable element means in one of a plurality of locations spaced from one another in the direction of elongation of the latter.

2. The device as defined in claim 1, wherein said resiliently deformable element means includes at least two resiliently deformable members connectable with one another so as to form together said resiliently deformable element means.

3. The device as defined in claim 1, wherein said second end section of said holding member is provided with a hollow handle element having a plurality of gripping sections spaced from one another in a direction of elongation of said holding element.

4. A Yoga exercising device, comprising an elongated resiliently deformable element means having one portion movable to a position in which said one portion is convex but tends to become straight under the action of its resiliency, and another portion on which a practitioner can rest, said one portion of said resiliently deformable element means having an initial position in which it has a substantially straight contour and from which it moves to said convex position; and holding means by which a practitioner holds said one portion of said resiliently deformable element means in its convex position so as to prevent said one portion from becoming straight, whereby said one convex portion acts upon the practitioner's body so as to bend the latter.

5. A Yoga exercising device, comprising an elongated resiliently deformable element means having one portion movable by a practitioner to a second position in which said one portion is convex but tends to become straight under the action of its resiliency, another portion on which a practitioner can rest, said resiliently defomable element means having a first position in which it is substantially curved in a convex position, said one portion having a first radius of curvature from which it moves to said convex position, said resiliently deformable element means having in said convex position a second radius of curvature which is smaller than said first radius of curvature; and practitioner holding means by which a practitioner holds said one portion of said resiliently deformable element means in its second convex position so as to prevent said one portion from becoming straight, whereby said one movable portion acts upon the practitioner's body so as to bend the latter.

6. A Yoga exercising device, comprising an elongated resiliently deformable element means having one portion movable by a practitioner to a position in which said one portion is convex but tends to become straight under the action of its resiliency, and another portion on which a practitioner can rest; holding means by which a practitioner holds said one portion of said resiliently deformable element means in its convex position so as to prevent said one portion from becoming straight, whereby said one convex portion acts upon the practitioner's body so as to bend the latter; and a stop member connected to said resiliently deformable element means so that the practitioner's feet can abut against said stop member when the practitioner rests on said other portion and holds said one portion.

7. The device as defined in claim 6, wherein at least a portion of said stop member is angularly movable relative to said resiliently deformable element means so that when the one portion of the latter becomes convex at least a portion of said stop member can move relative to said resiliently deformable element so as to assume an angular position which is convenient for practitioner's feet.

8. A Yoga exercising device, comprising an elongated resiliently deformable element means having one portion movable to a position in which said one portion is convex but tends to become straight under the action of its resiliency, and another portion on which a practitioner can rest, said resiliently deformable element means being adjustable in the direction of elongation so as to vary its length; means for adjusting and fixing the length of said resiliently deformable element means; and holding means by which a practitioner holds said one portion of said resiliently deformable element means in its convex position so as to prevent said portion from becoming straight, whereby said one convex portion acts upon the practitioner's body so as to bend the latter.

* * * * *